US009401138B2

(12) United States Patent
Kato

(10) Patent No.: US 9,401,138 B2
(45) Date of Patent: Jul. 26, 2016

(54) SEGMENT INFORMATION GENERATION DEVICE, SPEECH SYNTHESIS DEVICE, SPEECH SYNTHESIS METHOD, AND SPEECH SYNTHESIS PROGRAM

(75) Inventor: Masanori Kato, Tokyo (JP)

(73) Assignee: NEC Corporation, Tokyo (JP)

( * ) Notice: Subject to any disclaimer, the term of this patent is extended or adjusted under 35 U.S.C. 154(b) by 184 days.

(21) Appl. No.: 14/114,891

(22) PCT Filed: May 10, 2012

(86) PCT No.: PCT/JP2012/003060

§ 371 (c)(1),
(2), (4) Date: Oct. 30, 2013

(87) PCT Pub. No.: WO2012/160767

PCT Pub. Date: Nov. 29, 2012

(65) Prior Publication Data

US 2014/0067396 A1 Mar. 6, 2014

(30) Foreign Application Priority Data

May 25, 2011 (JP) ..... 2011-117155

(51) Int. Cl.
*G10L 13/00* (2006.01)
*G10L 13/06* (2013.01)

(52) U.S. Cl.
CPC ..... *G10L 13/00* (2013.01); *G10L 13/06* (2013.01)

(58) Field of Classification Search
CPC ..... G10L 13/02; G10L 13/00; G10L 13/08; G10L 13/043; G10L 13/027; G10L 13/033; G10L 13/10; G10L 13/04; G10L 13/07; G10L 21/003
USPC ..... 704/260, 261, 258, 254, 267, 266, 268, 704/269
See application file for complete search history.

(56) References Cited

U.S. PATENT DOCUMENTS 4,797,930 A * 1/1989 Goudie ..... G10L 13/10 704/268
5,327,498 A * 7/1994 Hamon ..... G10L 13/07 704/260

(Continued)

FOREIGN PATENT DOCUMENTS

JP 10-207488 A 8/1998
JP 2001034284 A 2/2001

(Continued)

OTHER PUBLICATIONS

International Search Report in PCT/JP2012/003060 dated Jun. 12, 2012 (English Translation Thereof).

(Continued)

*Primary Examiner* — Edgar Guerra-Erazo
(74) *Attorney, Agent, or Firm* — McGinn IP Law Group, PLLC

(57) ABSTRACT

A segment information generation device includes a waveform cutout unit cuts out a speech waveform from natural speech at a time period not depending on a pitch frequency of the natural speech. A feature parameter extraction unit extracts a feature parameter of a speech waveform from the speech waveform cut out by the waveform cutout unit. A time domain waveform generation unit generates a time domain waveform based on the feature parameter.

12 Claims, 10 Drawing Sheets

(56) References Cited

U.S. PATENT DOCUMENTS

| | | | | |
|---|---|---|---|---|
| 5,860,064 | A * | 1/1999 | Henton | G10L 13/033 204/266 |
| 5,864,812 | A * | 1/1999 | Kamai | G10L 13/02 704/258 |
| 7,251,601 | B2 * | 7/2007 | Kagoshima | G10L 13/04 704/268 |
| 7,415,414 | B2 * | 8/2008 | Azara | G06F 17/279 704/270 |
| 7,542,903 | B2 * | 6/2009 | Azara | G06F 17/279 704/1 |
| 8,484,035 | B2 * | 7/2013 | Pentland | H04S 1/007 704/235 |
| 8,494,856 | B2 * | 7/2013 | Latorre | G10L 13/10 345/440.1 |
| 8,781,819 | B2 * | 7/2014 | Kawahara | G10L 13/033 704/207 |
| 2002/0138253 | A1 * | 9/2002 | Kagoshima | G10L 13/04 704/207 |
| 2005/0065784 | A1 * | 3/2005 | McAulay | G10L 19/093 704/205 |
| 2005/0182618 | A1 * | 8/2005 | Azara | G06F 17/279 704/9 |
| 2005/0182625 | A1 * | 8/2005 | Azara | G06F 17/279 704/236 |
| 2006/0136213 | A1 * | 6/2006 | Hirose | G10L 13/033 704/260 |
| 2008/0044048 | A1 * | 2/2008 | Pentland | H04S 1/007 381/315 |
| 2011/0015931 | A1 * | 1/2011 | Kawahara | G10L 13/033 704/264 |
| 2012/0089402 | A1 * | 4/2012 | Latorre | G10L 13/10 704/260 |

FOREIGN PATENT DOCUMENTS

| | | | |
|---|---|---|---|
| JP | 2001-083978 | A | 3/2001 |
| JP | 2003-223180 | A | 8/2003 |
| JP | 2011-090218 | A | 5/2011 |

OTHER PUBLICATIONS

Eric Moulines, Francis Charpentier, "Pitch-Synchronous Waveform Processing Techniques for Text-To-Speech Synthesis Using Diphones", Speech Communication vol. 9, pp. 453-467, 1990.

Masanobu Abe, "An introduction to speech synthesis units", IEICE, IEICE research paper, vol. 100, No. 392, pp. 35-42, 2000.

Sadaoki Furui, "Speech Information Processing", Morikita Publishing Co., Ltd., pp. 16-33, 1998.

Shuzo Saito and Kazuo Nakata, "Basic Speech Information Processing", Ohmsha, Ltd, pp. 14-31, pp. 73-77, 1981.

H. Kawahara, "Speech Representation and Transformation Using Adaptive Interpolation of Weighted Spectrum: Vocoder Revisited", IEEE ICASSP-97, vol. 2, pp. 1303-1306, 1997.

Yasushi Ishikawa, "Prosodic Control for Japanese Text-to-Speech Synthesis", IEICE, IEICE research paper, vol. 100, No. 392, pp. 27-34, 2000.

Huang, Acero, Hon, "Spoken Language Processing", Prentice Hall, pp. 689-836, 2001.

m

* cited by examiner

| | PITCH FREQUENCY | DURATION | POWER | POSITION FROM ACCENT NUCLEUS |
|---|---|---|---|---|
| TARGET SEGMENT | pitch0 | dur0 | pow0 | pos0 |
| CANDIDATE SEGMENT A1 | pitch1 | dur1 | pow1 | pos1 |
| CANDIDATE SEGMENT A2 | pitch2 | dur2 | pow2 | pos2 |

| | BEGINNING PITCH FREQUENCY | END PITCH FREQUENCY | BEGINNING POWER | END POWER |
|---|---|---|---|---|
| CANDIDATE SEGMENT A1 | pitch_beg1 | pitch_end1 | pow_beg1 | pow_end1 |
| CANDIDATE SEGMENT A2 | pitch_beg2 | pitch_end2 | pow_beg2 | pow_end2 |
| CANDIDATE SEGMENT B1 | pitch_beg3 | pitch_end3 | pow_beg3 | pow_end3 |
| CANDIDATE SEGMENT B2 | pitch_beg4 | pitch_end4 | pow_beg4 | pow_end4 |

SEGMENT INFORMATION GENERATION DEVICE, SPEECH SYNTHESIS DEVICE, SPEECH SYNTHESIS METHOD, AND SPEECH SYNTHESIS PROGRAM

TECHNICAL FIELD

The present invention relates to a segment information generation device that generates segment information used for synthesizing speech, a segment information generating method and a segment information generating program, as well as a speech synthesis device that synthesizes speech by use of segment information, a speech synthesis method and a speech synthesis program.

BACKGROUND ART

There is known a speech synthesis device that analyzes character string information indicating a character string, and generating synthesis speech by regular synthesis from speech information indicated by the character string. In the speech synthesis device that generates synthesis speech by regular synthesis, prosody information on synthesis speech (information on tone pitch (pitch frequency), tone length (prosodic duration), and sound magnitude (power)) is first generated based on an analysis result of the input character string information. Then, a plurality of optimum segments (waveform generation parameter sequences having a length of syllable or demisyllable) are selected from a segment dictionary based on the character string analysis result and the generated prosody information, thereby creating one optimum segment sequence. Then, a waveform generation parameter sequence is formed by the optimum segment sequence and a speech waveform is generated from the waveform generation parameter sequence, thereby obtaining synthesis speech. The segments accumulated in the segment dictionary are extracted and generated from a large amount of natural speech in various methods.

In such a speech synthesis device, a speech waveform having prosody close to the generated prosody information is created from segments in order to secure high sound quality when generating a synthesis speech waveform from selected segments. A method for generating both a synthesis speech waveform and segments used for generating the synthesis speech waveform employs the method described in Non-Patent Literature 1, for example. A waveform generation parameter generated by the method described in Non-Patent literature 1 is cut out from a speech waveform by use of a window function having a parameter (more specifically, a time width calculated from a pitch frequency) in a time domain. Therefore, the processings such as frequency conversion, logarithm conversion and filtering are not required for the waveform generation, and thus a synthesis speech waveform can be generated with fewer calculations.

Patent Literature 1 describes a speech recognition device and Patent Literature 2 describes a speech segment generation device.

CITATION LIST

Patent Literature

Patent Literature 1: JP 2001-83978 A
Patent Literature 2: JP 2003-223180 A

Non-Patent Literature

Non-Patent Literature 1: Eric Moulines, Francis Charpentier, "Pitch-Synchronous Waveform Processing Techniques For Text-To-Speech Synthesis Using Diphones", Speech Communication Vol. 9, pp. 453-467, 1990

SUMMARY OF INVENTION

Technical Problem

However, there is a problem that an analysis frame period cannot be freely set for creating a segment with the waveform generating method and the segment dictionary creating method descried in Non-Patent Literature 1.

When a waveform generation parameter is generated from a natural speech waveform, a waveform is cut out in a time interval called analysis frame period thereby to generate the waveform generation parameter. That is, the analysis frame period is a time interval in which a waveform is cut out to generate a waveform generation parameter when a waveform generation parameter is generated from a natural speech waveform. With the technique described in Non-Patent Literature 1, an analysis frame period depending on a pitch frequency is used. Specifically, with the technique described in Non-Patent Literature 1, a pitch frequency of natural speech (containing a pitch frequency estimated value based on pitch frequency analysis) is used thereby to use an analysis frame period corresponding to a pitch frequency. With the technique described in Non-Patent Literature 1, the analysis frame period is uniquely defined by a pitch frequency.

Therefore, a waveform generation parameter time series having a sufficient time resolution (parameter values per unit time) cannot be obtained in an interval in which a speech spectrum shape rapidly changes, which may cause a deterioration in sound quality of synthesis speech. This is conspicuous in an interval in which a pitch frequency of speech to be analyzed is low. In an interval in which a change in speech spectrum shape is small, a waveform generation parameter time series having an excess time resolution is generated, which may uselessly increase a data size of the segment dictionary. This is conspicuous in an interval in which the pitch frequency of speech to be analyzed is high.

It is an object of the present invention to provide a segment information generation device, a segment information generating method and a segment information generating program as well as a speech synthesis device, a speech synthesis method and a speech synthesis program capable of preventing a deterioration in sound quality of synthesis speech even when a segment in an interval in which a pitch frequency of natural speech as segment creation source is low is used, and reducing the amount of segment information data in an interval in which a pitch frequency is high without losing the sound quality of synthesis speech, while presenting an advantage that a waveform can be generated with fewer calculations features of a time domain parameter.

Solution to Problem

A segment information generation device according to the present invention includes: a waveform cutout means that cuts out a speech waveform from natural speech at a time period not depending on a pitch frequency of the natural speech; a feature parameter extraction means that extracts a feature parameter of a speech waveform from the speech waveform cut out by the waveform cutout means; and a time domain waveform generation means that generates a time domain waveform based on the feature parameter.

Further, a speech synthesis device according to the present invention includes: a waveform cutout means that cuts out a speech waveform from natural speech at a time period not depending on a pitch frequency of the natural speech; a feature parameter extraction means that extracts a feature parameter of a speech waveform from the speech waveform cut out by the waveform cutout means; a time domain waveform generation means that generates a time domain waveform based on the feature parameter; a segment information storage means that stores segment information indicating a segment and containing the time domain waveform; a segment information selection means that selects segment information corresponding to an input character string; and a waveform generation means that generates a speech synthesis waveform by use of the segment information selected by the segment information selection means.

Further, a segment information generating method according to the present invention includes the steps of: cutting out a speech waveform from natural speech at a time period not depending on a pitch frequency of the natural speech; extracting a feature parameter of the speech waveform from the speech waveform; and generating a time domain waveform based on the feature parameter.

Further, a speech synthesis method according to the present invention includes the steps of: cutting out a speech waveform from natural speech at a time period not depending on a pitch frequency of the natural speech; extracting a feature parameter of the speech waveform from the speech waveform; generating a time domain waveform based on the feature parameter; storing segment information indicating a segment and containing the time domain waveform; selecting segment information corresponding to an input character string; and generating a speech synthesis waveform by use of the selected segment information.

Further, a segment information generating program according to the present invention causes a computer to perform: a waveform cutout processing of cutting out a speech waveform from natural speech at a time period not depending on a pith frequency of the natural speech; a feature parameter extraction processing of extracting a feature parameter of a speech waveform from the speech waveform cut out in the waveform cutout processing; and a time domain waveform generation processing of generating a time domain waveform based on the feature parameter.

A speech synthesis program according to the present invention causes a computer to perform; a waveform cutout processing of cutting out a speech waveform from natural speech at a time period not depending on a pitch frequency of the natural speech; a feature parameter extraction processing of extracting a feature parameter of a speech waveform from the speech waveform cut out in the waveform cutout processing; a time domain waveform generation processing of generating a time domain waveform based on the feature parameter; a storage processing of storing segment information indicating a segment and containing the time domain waveform; a segment information selection processing of selecting segment information corresponding to an input character string; and a waveform generation processing of generating a speech synthesis waveform by use of the segment information selected in the segment information selection processing.

Advantageous Effects of Invention

According to the present invention, it is possible to generate a waveform with fewer calculations, to prevent a deterioration in sound quality of synthesis speech even when a segment in an interval in which a pitch frequency of natural speech as segment creation source is low is used, and to reduce the amount of segment information data in an interval in which a pitch frequency is high without losing the sound quality of synthesis speech.

DESCRIPTION OF EMBODIMENTS

Exemplary embodiments according to the present invention will be described below with reference to the drawings.

First Exemplary Embodiment

Figure 1:
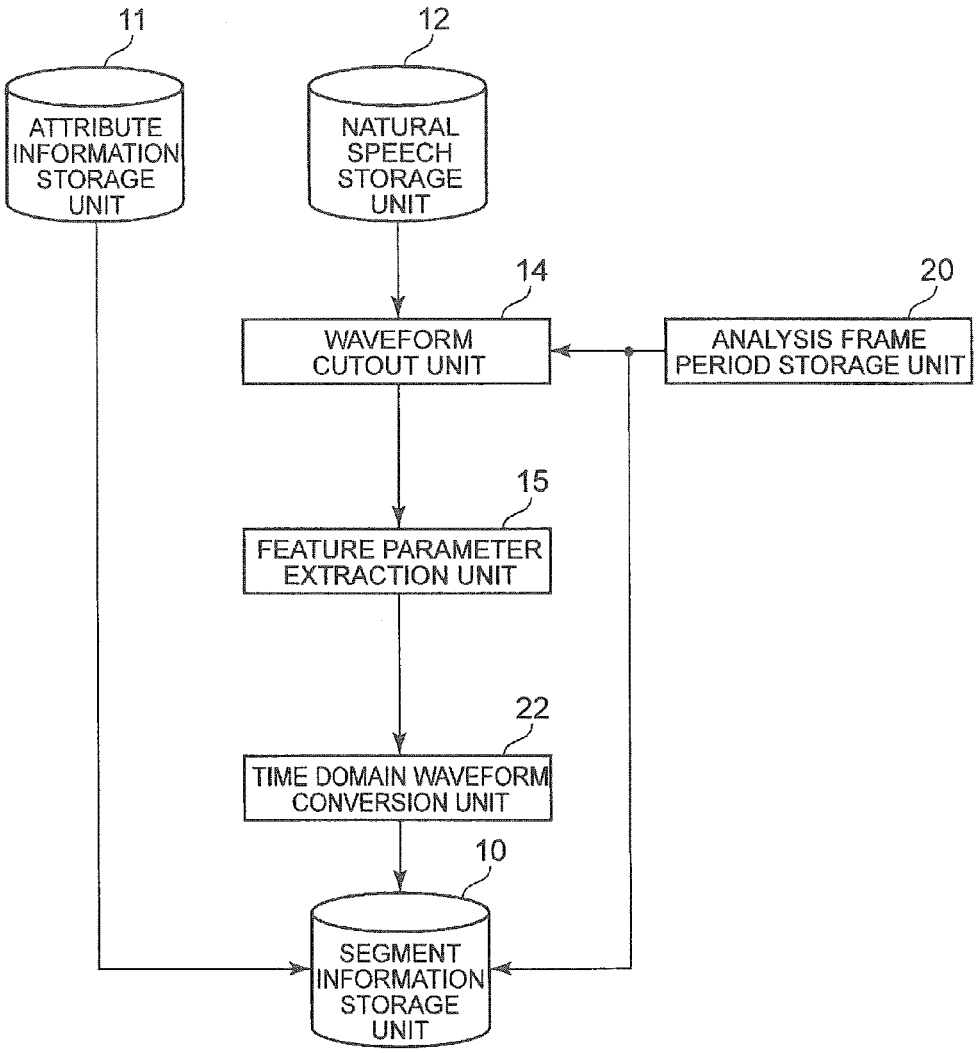
FIG. 1 It depicts a block diagram illustrating an exemplary segment information generation device according to a first exemplary embodiment of the present invention.

FIG. 1 is a block diagram illustrating an exemplary segment information generation device according to a first exemplary embodiment of the present invention. The segment information generation device according to the present exemplary embodiment includes a segment information storage unit 10, an attribute information storage unit 11, a natural speech storage unit 12, an analysis frame period storage unit 20, a waveform cutout unit 14, a feature parameter extraction unit 15, and a time domain waveform conversion unit 22.

The natural speech storage unit 12 stores information indicating basic speech (natural speech waveform) on which generation of segment information is based.

The segment information contains speech segment information indicating speech segments, and attribute information indicating attributes of the respective speech segments. Herein, the speech segment is part of basic speech (human speech (natural speech)) on which a speech synthesis processing of synthesizing speech is based, and is generated by dividing the basic speech in units of speech synthesis.

In the present example, speech segment information is extracted from a speech segment, and contains time series data of feature parameters indicating the features of the speech segment. The speech synthesis unit is a syllable. The speech synthesis unit may be phoneme, demisyllable such as CV (V denotes vowel and C denotes consonant), CVC, VCV and the like as described in Reference 1 cited later.

[Reference 1]

Masanobu Abe, "An introduction to speech synthesis units", IEICE, IEICE research paper, Vol. 100, No. 392, pp. 35-42, 2000

The attribute information contains an environment (phoneme environment) of basic speech of each speech segment, and prosody information (such as fundamental frequency (pitch frequency), amplitude, and duration).

Exemplary segment information will be specifically explained. The segment information contains speech segment information, attribute information, and waveform generation parameter generating conditions. Herein, an explanation will be made by way of "syllable" as speech synthesis unit.

The speech segment information may be called parameter for generating a synthesis speech waveform (waveform generation parameter). Exemplary speech segment information may be a time series of pitch waveform (waveform generated by the time domain waveform conversion unit 22), a time series of cepstrum, or a waveform itself (time length is unit length (syllable length)) described later, for example.

The attribute information employs prosody information or linguistic information, for example. Exemplary prosody information may be pitch frequency (such as head, tail and average pitch frequencies), duration, power and the like. The linguistic information may be pronunciation (such as "ha" in a Japanese word "o ha yo u"), syllable string, phoneme string, position information based on accent position, position information based on accent phrase separation, morphemic word class, and the like. The syllable string is made of a preceding syllable (such as "o" in "o ha yo u"), a syllable preceding the preceding syllable, a subsequent syllable (such as "yo" in "o ha yo u"), and a syllable following the subsequent syllable. The phoneme string is made of preceding phoneme (such as "o" in "o ha yo u"), phoneme preceding the preceding phoneme, subsequent phoneme (such as "y" in "o ha yo u"), and phoneme following the subsequent phoneme. The position information based on accent position indicates "what number syllable from the accent position", for example. The position information based on accent phrase separation indicates "what number syllable from accent phrase separation", for example.

The waveform generation parameter generating conditions may be parameter type, parameter dimension number (such as 10-dimension or 24-dimension), analysis frame length, analysis frame period, and the like. Exemplary parameter types may be cepstrum, Linear Predictive Coefficient (LPC), MFCC, and the like.

The attribute information storage unit 11 stores, as attribute information, linguistic information containing information indicating character strings (recorded sentences) corresponding to basic speech stored in the natural speech storage unit 12, and prosody information of the basic speech. The linguistic information may be information on kanji-kana mixed sentences, for example. Further, the linguistic information may include information on pronunciation, syllable string, phoneme string, accent position, accent phrase separation and morphemic word class. The prosody information includes pitch frequency, amplitude, short-time power time series, and duration of respective syllables, phonemes and pauses contained in natural speech.

The analysis frame period storage unit 20 stores a time period (or analysis frame period) in which the waveform cutout unit 14 cuts out a waveform from a natural speech waveform. The analysis frame period storage unit 20 stores an analysis frame period defined not depending on a pitch frequency of natural speech. The analysis frame period defined not depending on a pitch frequency of natural speech may be called analysis frame period defined independent of a pitch frequency of natural speech.

Basically, as the value of the analysis frame period is reduced, sound quality of synthesis speech is improved and the amount of segment information data increases. However, sound quality is not necessarily improved even if the analysis frame period is reduced. An improvement in sound quality along with a reduction in analysis frame period is limited to human voice tone, more specifically to an upper limit value of the pitch frequency of natural speech. For example, since the pitch frequency of adult female voice rarely exceeds 1,000 Hz, even if the analysis frame period is set at 1 millisecond (=1/1,000 seconds) or less for female announcer voice, sound quality of synthesis speech is rarely improved. Even if the analysis frame period is set at 2 milliseconds or less for male announcer voice, sound quality of synthesis speech is less likely to be improved. When singing voice or child voice is synthesized, a much smaller value than the analysis frame period has to be employed. An excessive increase in analysis frame period causes a serious impact on the quality of synthesis speech. For example, duration of phoneme contained in speaking voice does not exceed 5,000 milliseconds at longest. Therefore, the analysis frame period exceeding 5,000 milliseconds should not be set in order to reduce the amount of segment information data.

The waveform cutout unit 14 cuts out a speech waveform from natural speech stored in the natural speech storage unit 12 at an analysis frame period stored in the analysis frame period storage unit 20, and transmits a time series of the cut-out speech waveform to the feature parameter extraction unit 15. A time length of a waveform to be cut out is called analysis frame length, and employs a preset value. The analysis frame length employs a value between 10 milliseconds and 50 milliseconds, for example. Then, the analysis frame length may always employ the same value (20 milliseconds, for example). A length of the natural speech waveform to be cut is various, but is as short as about several seconds and is always several hundred times longer than the analysis frame length. For example, it is assumed that the analysis frame length is N, the natural speech waveform is s(t) (where, t=0, 1, . . . , N−1), and the analysis frame period is T. Further, the natural speech waveform length is assumed as L. A short waveform is cut out from a long natural speech waveform, and thus a relationship of L>>N is established. At this time, assuming the n-th frame cutout waveform as $x_n(t)$, $x_n(t)$ is expressed in the following Equation (1).

[Math. 1]

$$x_n(t)=s(t+nT) \quad \text{Equation (1)}$$

where n=0, 1, . . . , (L/N)−1. When L/N is not an integer, L/N is truncated to the whole number to obtain an integer of (L/N)−1.

The feature parameter extraction unit 15 extracts a feature parameter of a speech waveform from the speech waveform supplied from the waveform cutout unit 14, and transmits it to the time domain waveform conversion unit 22. A plurality of cutout waveforms having a preset analysis frame length are supplied from the waveform cutout unit 14 to the feature parameter extraction unit 15 at time intervals of the analysis frame period. The feature parameter extraction unit 15 extracts feature parameters one by one from the plurality of the supplied cutout waveforms. Exemplary feature parameters may be power spectrum, linear predictive coefficient, cepstrum, melcepstrum, LSP, STRAIGHT spectrum, and the like, for example. A method for extracting a feature parameter from a cutout speech waveform is described in References 2, 3 and 4 cited later.

[Reference 2]

Sadaoki Furui, "Speech Information Processing", Morikita Publishing Co., Ltd., pp. 16-33, 1998

[Reference 3]

Shuzo Saito and Kazuo Nakata, "Basic Speech Information Processing", Ohmsha, Ltd, pp. 14-31, pp. 73-77, 1981

[Reference 4]

H. Kawahara, "Speech representation and transformation using adaptive interpolation of weighted spectrum: vocoder revisited", IEEE ICASSP-97, vol. 2, pp. 1303-1306, 1997

There will be described herein an example in which cepstrum is extracted as a feature parameter from a speech waveform cut out in the waveform cutout unit 14.

The n-th frame cutout waveform is assumed as $x_n(t)$ (where t=0, 1, . . . , N−1). At this time, assuming cepstrum as $c_n(k)$, $c_n(k)$ is expressed in the following Equation (2), and the feature parameter extraction unit 15 may find cepstrum $c_n(k)$ from the Equation (2).

[Math. 2]

$$c_n(k) = \sum_{\omega=0}^{N-1} \left( \log \left| \sum_{t=0}^{N-1} x_n(t) e^{-j2\pi \frac{t}{N}\omega} \right| \right) e^{j2\pi \frac{\omega}{N} k} \quad \text{Equation (2)}$$

where k=0, 1, . . . , K−1 and K is a length of the feature parameter. That is, cepstrum is obtained by performing Fourier transform on the cutout waveform, calculating a logarithm of its absolute value (which may be called amplitude spectrum), and performing inverse Fourier transform. The length K of the feature parameter may be a value smaller than N.

The time domain waveform conversion unit 22 converts a time series of the feature parameters extracted by the feature parameter extraction unit 15 into time domain waveforms in units of frame one by one. The converted time domain waveforms are waveform generation parameters of the synthesis speech. In the present specification, a waveform generated by the time domain waveform conversion unit 22 is called pitch waveform in order to discriminate from a natural speech waveform or synthesis speech waveform. A method for converting a time series of feature parameters extracted by the feature parameter extraction unit 15 into time domain waveforms is different depending on a nature of a feature parameter. For example, in the case of subband power spectrum, inverse Fourier transform is used. A method for converting various feature parameters exemplified in the description of the feature parameter extraction unit 15 (such as power spectrum, linear predictive coefficient, cepstrum, melcepstrum, LSP, and STRAIGHT spectrum) into time domain waveforms is described in References 2, 3 and 4 cited above. Herein, a method for finding a time domain waveform from cepstrum will be described by way of example.

The n-th frame cepstrum is assumed as $c_n(k)$ (where k=0, 1, . . . , K−1). Further, a time domain waveform (or pitch waveform) is assumed as $y_n(t)$ (where t=0, 1, . . . , N−1). $y_n(t)$ is expressed in the following Equation (3) and the time domain waveform conversion unit 22 may find $y_n(t)$ from the Equation (3).

[Math. 3]

$$y_n(t) = \sum_{\omega=0}^{N-1} \left( \sum_{k=0}^{K-1} c_n(k) e^{-j2\pi \frac{k}{K}\omega} \right) e^{j2\pi \frac{\omega}{N} t} \quad \text{Equation (3)}$$

That is, the pitch waveform is obtained by performing Fourier transform on cepstrum and further performing inverse Fourier transform.

The segment information storage unit 10 stores the segment information containing the attribute information supplied from the attribute information storage unit 11, the pitch waveform supplied from the time domain waveform conversion unit 22 and the analysis frame period stored in the analysis frame period storage unit 20.

The segment information stored in the segment information storage unit 10 is used for the speech synthesis processing in the speech synthesis device (not illustrated in FIG. 1). That is, after segment information is stored in the segment information storage unit 10, when receiving a text to be subjected to the speech synthesis processing, the speech synthesis device performs the speech synthesis processing of synthesizing speech indicating the received text based on the segment information stored in the segment information storage unit 10.

The waveform cutout unit 14, the feature parameter extraction unit 15 and the time domain waveform conversion unit 22 are accomplished by the CPU in a computer including a storage device and operating according to a segment information generating program, for example. In this case, a program storage device (not illustrated) in the computer may store the segment information generating program and the CPU reads the program to function as the waveform cutout unit 14, the feature parameter extraction unit 15 and the time domain waveform conversion unit 22 according to the program. The waveform cutout unit 14, the feature parameter extraction unit 15 and the time domain waveform conversion unit 22 may be accomplished in individual hardware.

Figure 2:
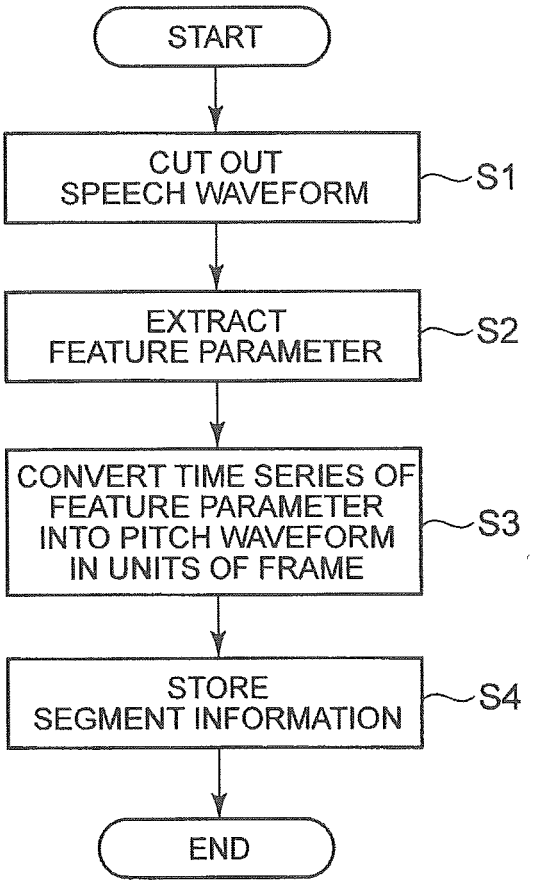
FIG. 2 It depicts a flowchart illustrating an exemplary processing progress according to the first exemplary embodiment of the present invention.

FIG. 2 is a flowchart illustrating an exemplary processing progress according to the first exemplary embodiment of the present invention. In the first exemplary embodiment, at first, the waveform cutout unit 14 cuts out a speech waveform from natural speech stored in the natural speech storage unit 12 at an analysis frame period defined not depending on a pitch frequency of the natural speech (step S1). The analysis frame period is previously stored in the analysis frame period storage unit 20, and the waveform cutout unit 14 may cut out the speech waveform at the analysis frame period stored in the analysis frame period storage unit 20. Then, the feature parameter extraction unit 15 extracts a feature parameter from the speech waveform (step S2). Then, the time domain waveform conversion unit 22 converts a time series of the feature parameter into a pitch waveform in units of frame (step S3). Then, the segment information storage unit 10 stores the segment information containing the attribute information supplied from the attribute information storage unit 11, the pitch waveform supplied from the time domain waveform conversion unit 22 and the analysis frame period stored in the analysis frame period storage unit 20 (step S4). The segment information stored in the segment information storage unit 10 is used for the speech synthesis processing in the speech synthesis device.

According to the present exemplary embodiment, a pitch waveform is generated at a certain analysis frame period when segment information is generated. Therefore, a waveform can be generated with fewer calculations when synthesis speech is generated similarly to the technique described in Non-Patent Literature 1. The analysis frame period used in the present exemplary embodiment is defined not depending on the pitch frequency of the natural speech. Thus, when speech synthesis is performed by use of a segment in an interval in which a pitch frequency of natural speech as segment creation source is low, a deterioration in sound quality of synthesis speech can be further prevented as compared with the technique described in Non-Patent Literature 1. As compared with the technique described in Non-Patent Literature 1, the amount of segment information data in an interval in which a pitch frequency is high can be reduced without losing the sound quality of the synthesis speech.

Second Exemplary Embodiment

A segment information generation device according to a second exemplary embodiment of the present invention controls an analysis frame period according to attribute information of a speech segment.

Figure 3:
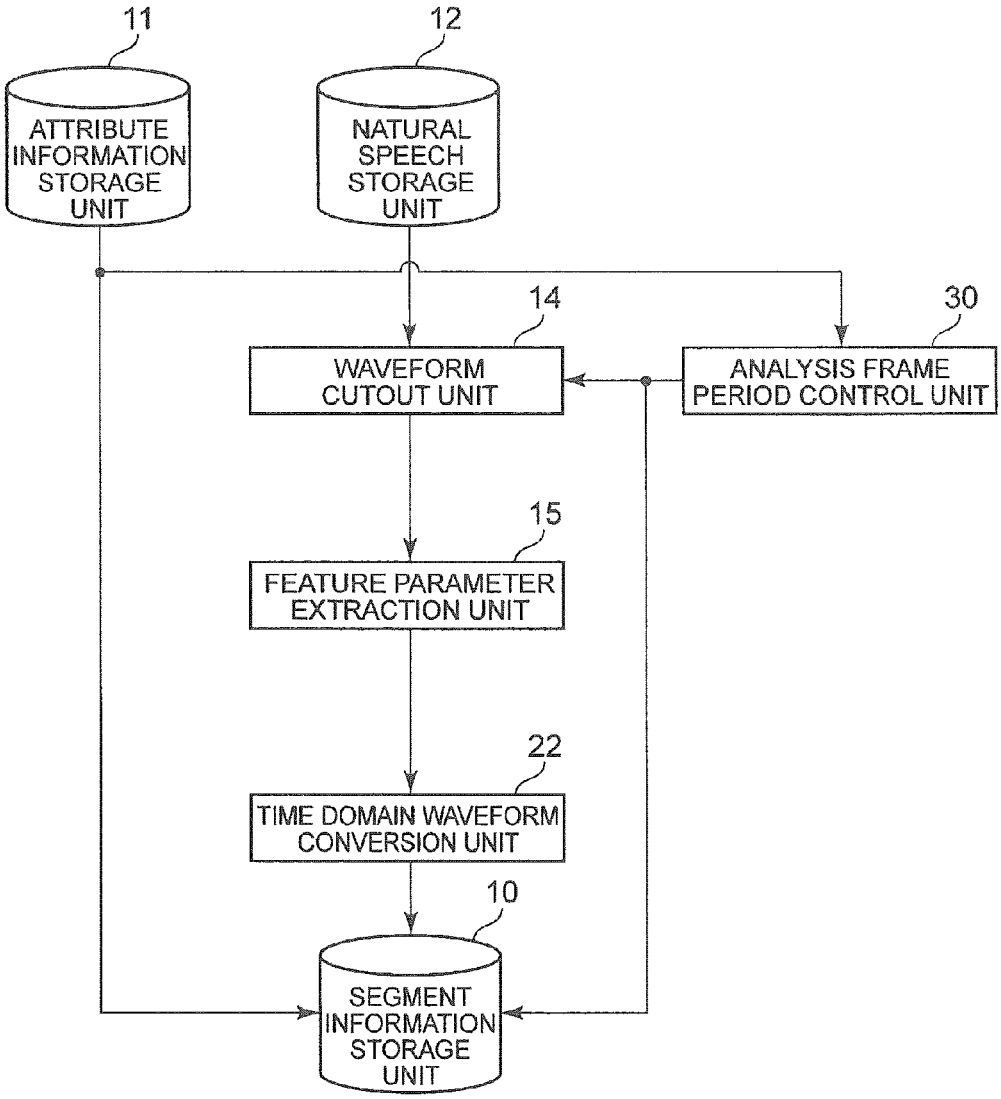
FIG. 3 It depicts a block diagram illustrating an exemplary segment information generation device according to a second exemplary embodiment of the present invention.

FIG. 3 is a block diagram illustrating an exemplary segment information generation device according to the second exemplary embodiment of the present invention. The same constituents as those in the first exemplary embodiment are denoted with the same numerals as those in FIG. 1, and a detailed explanation thereof will be omitted. The segment information generation device according to the present exemplary embodiment includes the segment information storage unit 10, the attribute information storage unit 11, the natural speech storage unit 12, an analysis frame period control unit 30, the waveform cutout unit 14, the feature parameter extraction unit 15, and the time domain waveform conversion unit 22. That is, the segment information generation device according to the present exemplary embodiment includes the analysis frame period control unit 30 instead of the analysis frame period storage unit 20 according to the first exemplary embodiment.

The analysis frame period control unit 30 calculates a proper analysis frame period based on the attribute information supplied from the attribute information storage unit 11, and transmits it to the waveform cutout unit 12. The analysis frame period control unit 30 uses linguistic information or prosody information contained in the attribute information for calculating the analysis frame period. When a type of phoneme or syllable in the linguistic information is used, a method for switching a frame period depending on a shape change speed of a speech spectrum with the type is effective. For example, since when an interval to be analyzed is a long vowel syllable, a change in spectrum shape is small in the interval, the analysis frame period control unit 30 prolongs the analysis frame period. Thereby, the number of frames in the interval can be reduced without losing sound quality of the synthesis speech. Since when an interval to be analyzed is a voiced consonant interval, a change in spectrum shape is large, the analysis frame period is shortened. Thereby, the sound quality of the synthesis speech when using a segment in the period is enhanced.

That is, the analysis frame period control unit 30 shortens the analysis frame period in an interval in which a degree of change in spectrum shape is estimated to be large, and prolongs the analysis frame period in an interval in which a degree of change in spectrum shape is estimated to be small on the basis of the attribute information of the segment. The spectrum shape change degree is a degree of change in spectrum shape.

The waveform cutout unit 14 cuts out a speech waveform from natural speech at an analysis frame period controlled by the analysis frame period control unit 30. Other points are similar as in the first exemplary embodiment.

The analysis frame period control unit 30, the waveform cutout unit 14, the feature parameter extraction unit 15 and the time domain waveform conversion unit 22 are accomplished by the CPU in a computer including a storage device and operating according to a segment information generating program, for example. In this case, the CPU may operate as the analysis frame period control unit 30, the waveform cutout unit 14, the feature parameter extraction unit 15 and the time domain waveform conversion unit 22 according to the segment information generating program. The analysis frame period control unit 30, the waveform cutout unit 14, the feature parameter extraction unit 15 and the time domain waveform conversion unit 22 may be accomplished in individual hardware.

In the present exemplary embodiment, the analysis frame period control unit 30 shortens the analysis frame period in an interval in which a degree of change in spectrum shape is estimated to be large, and prolongs the analysis frame period in an interval in which a degree of change in spectrum shape is estimated to be small. Consequently, there is a more advantageous effect than in the first exemplary embodiment that when speech synthesis is performed by use of a segment in an interval in which a pitch frequency of natural speech as segment creation source is low, a deterioration in sound quality of the synthesis speech can be prevented and the amount of segment information data in an interval in which a pitch frequency is high can be reduced without losing the sound quality of the synthesis speech.

In the second exemplary embodiment, the analysis frame period control unit 30 controls the analysis frame period based on the attribute information. At this time, the analysis frame period control unit 30 does not use the pitch frequency of the natural speech. Therefore, the analysis frame period according to the second exemplary embodiment does not depend on a pitch frequency similarly as in the first exemplary embodiment.

Third Exemplary Embodiment

A segment information generation device according to a third exemplary embodiment of the present invention analyzes natural speech to calculate a degree of change in spectrum shape, and controls an analysis frame period depending on the degree of change in spectrum shape.

Figure 4:
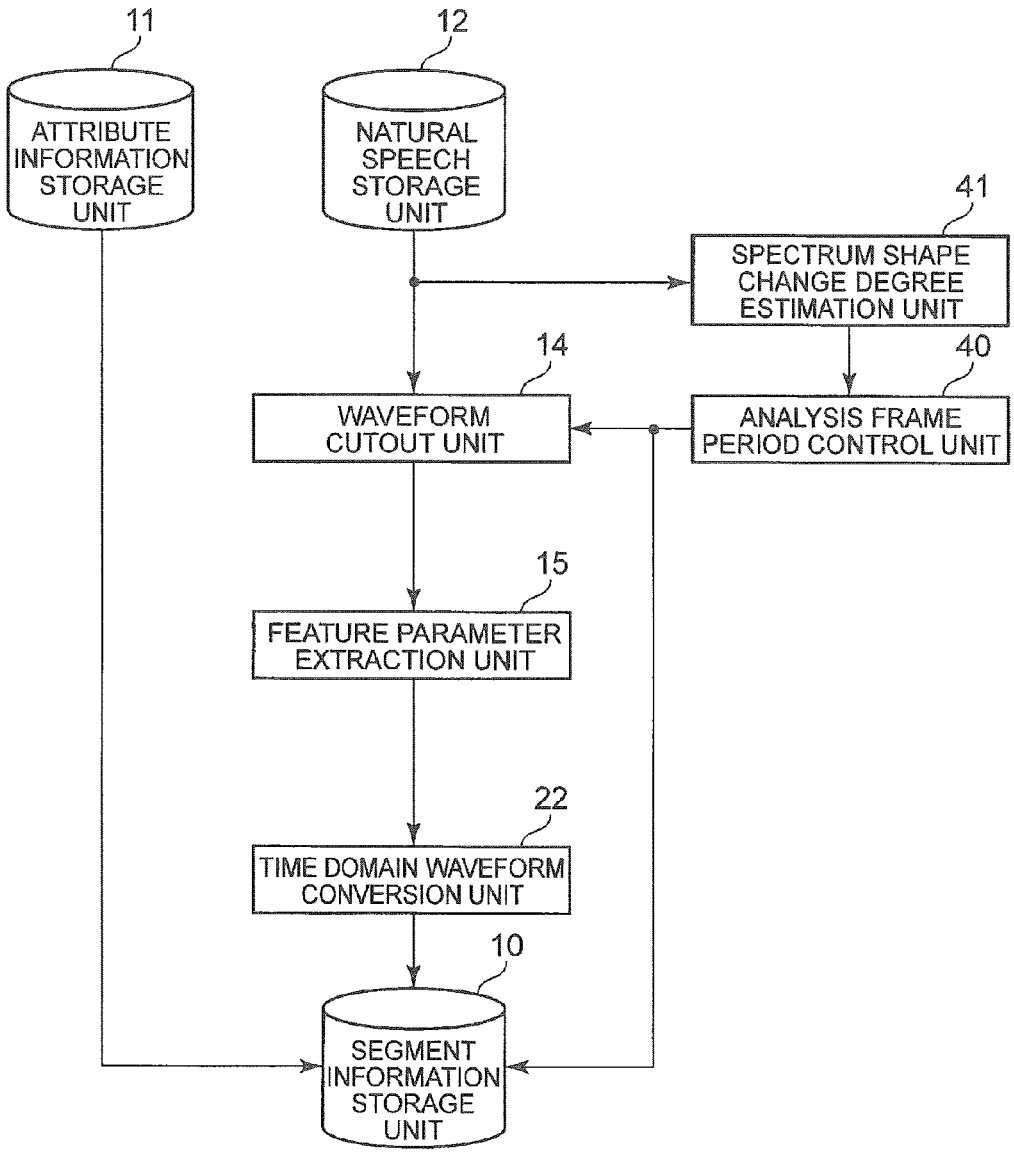
FIG. 4 It depicts a block diagram illustrating an exemplary segment information generation device according to a third exemplary embodiment of the present invention.

FIG. 4 is a block diagram illustrating an exemplary segment information generation device according to the third exemplary embodiment of the present invention. The same constituents as those in the first exemplary embodiment or second exemplary embodiment are denoted with the same numerals as those in FIG. 1 or FIG. 3, and a detailed explanation thereof will be omitted. The segment information generation device according to the present exemplary embodiment includes the segment information storage unit 10, the attribute information storage unit 11, the natural speech storage unit 12, a spectrum shape change degree estimation unit 41, an analysis frame period control unit 40, the waveform cutout unit 14, the feature parameter extraction unit 15, and the time domain waveform conversion unit 22. That is, the segment information generation device according to the present exemplary embodiment includes the spectrum shape change degree estimation unit 41 and the analysis frame period control unit 40 instead of the analysis frame period storage unit 20 in the first exemplary embodiment.

The spectrum shape change degree estimation unit 41 estimates a degree of change in spectrum shape of natural speech supplied from the natural speech storage unit 12, and transmits it to the analysis frame period control unit 40.

In the second exemplary embodiment, an interval in which a degree of change in spectrum shape is estimated to be large or an interval in which a degree of change in spectrum shape is estimated to be small is determined based on attribute information of a segment, thereby to control an analysis frame period. To the contrary, in the third exemplary embodiment, the spectrum shape change degree estimation unit 41 directly analyzes natural speech to estimate a degree of change in spectrum shape.

The spectrum shape change degree estimation unit 41 may find various parameters indicating a spectrum shape to assume the changes of the parameters per unit time as a degree of change in spectrum shape. A K-dimensional parameter indicating a spectrum shape at the n-th frame is assumed as $p_n$, and $p_n$ is expressed in the following Equation (4).

[Math. 4]

$$p_n=(p_n(0),p_n(1),\ldots,p_n(K-1)) \quad \text{Equation (4)}$$

At this time, assuming a degree of change in spectrum shape at the n-th frame as $\Delta p_n$, $\Delta p_n$ can be calculated in the following Equation (5), for example.

[Math. 5]

$$\Delta p_n=\sum_{k=0}^{K-1}(p_{n+1}(k)-p_n(k))^2 \quad \text{Equation (5)}$$

Equation (5) means that a difference between the n-th frame and the n+1-th frame is calculated per order (or per element) of $p_n$ indicated by a vector and its square sum is assumed as a degree of change in spectrum change $\Delta p_n$.

$\Delta p_n$ calculated in the following Equation (6) may be assumed as a degree of change in spectrum shape.

[Math. 6]

$$\Delta p_n=\sum_{k=0}^{K-1}|p_{n+1}(k)-p_n(k)| \quad \text{Equation (6)}$$

Equation (6) means that the absolute value of a difference between the n-th frame and the n+1-th frame is calculated per order (or per element) of $p_n$ indicated by a vector, and its sum is assumed as a degree of change in spectrum shape $\Delta p_n$.

A parameter similar to the feature parameter extracted by the feature parameter extraction unit 15 may be used as a parameter indicating the spectrum shape. For example, cepstrum can be used as a parameter indicating the spectrum shape. In this case, the spectrum shape change degree estimation unit 41 may extract cepstrum from a natural speech waveform in the same method as how the feature parameter extraction unit 15 descried in the first exemplary embodiment extracts cepstrum.

The analysis frame period control unit 40 finds a proper analysis frame period based on the degree of change in spectrum shape supplied from the spectrum shape change degree estimation unit 41, and transmits it to the waveform cutout unit 14. The analysis frame period control unit 40 prolongs the analysis frame period in an interval in which a degree of change in spectrum shape is small. More specifically, the analysis frame period control unit 40 switches the analysis frame period to a larger value than during normal time when the degree of change in spectrum shape lowers a previously-defined first threshold. On the other hand, the analysis frame period control unit 40 shortened the analysis frame period in an interval in which a degree of change in spectrum shape is large. More specifically, when the degree of change in spectrum shape exceeds a previously-defined second threshold, the analysis frame period control unit 40 switches the analysis frame period to a smaller value than during normal time. The second threshold is defined to be larger than the first threshold.

The spectrum shape change degree estimation unit 41, the analysis frame period control unit 40, the waveform cutout unit 14, the feature parameter extraction unit 15 and the time domain waveform conversion unit 22 are accomplished by the CPU in a computer including a storage device and operating according to a segment information generating program, for example. In this case, the CPU may operate as the spectrum shape change degree estimation unit 41, the analysis frame period control unit 40, the waveform cutout unit 14, the feature parameter extraction unit 15 and the time domain waveform conversion unit 22 according to the segment information generating program. The spectrum shape change degree estimation unit 41, the analysis frame period control unit 40, the waveform cutout unit 14, the feature parameter extraction unit 15 and the time domain waveform conversion unit 22 may be accomplished in individual hardware.

According to the present exemplary embodiment, the spectrum shape change degree estimation unit 41 analyzes a natural speech waveform to be analyzed thereby to find a degree of change in spectrum shape. Then, the analysis frame period control unit 40 shortens the frame period in an interval in which the degree of change in spectrum shape is large, and prolongs the frame period in an interval in which the estimated degree of change is small. Therefore, there is a more advantageous effect than in the first exemplary embodiment that when speech synthesis is performed by use of a segment in an interval in which a pitch frequency of natural speech as segment creation source is low, a deterioration in sound quality of synthesis speech can be prevented and the amount of segment information data in an interval in which a pitch frequency is high can be reduced without losing the sound quality of the natural speech.

In the third exemplary embodiment, the analysis frame period control unit 40 controls an analysis frame period according to a degree of change in spectrum shape. At this time, the analysis frame period control unit 40 does not use a pitch frequency of natural speech. Therefore, the analysis frame period according to the third exemplary embodiment does not depend on a pitch frequency similarly as in the first exemplary embodiment.

Fourth Exemplary Embodiment

Figures 5, 6:
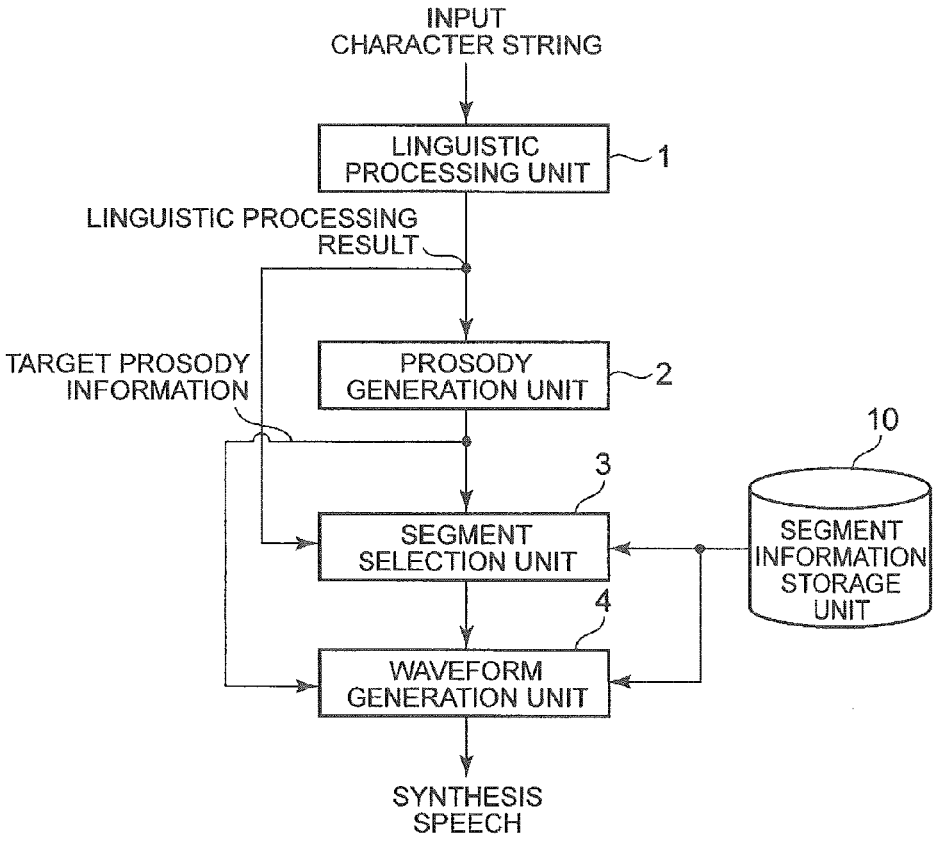
FIG. 5 It depicts a block diagram illustrating an exemplary speech synthesis device according to a fourth exemplary embodiment of the present invention.
FIG. 6 It depicts an explanatory diagram illustrating exemplary respective information indicated by a target segment environment and candidate segments.

FIG. 5 is a block diagram illustrating an exemplary speech synthesis device according to a fourth exemplary embodiment of the present invention. The speech synthesis device according to the fourth exemplary embodiment of the present invention includes a linguistic processing unit 1, a prosody generation unit 2, a segment selection unit 3 and a waveform generation unit 4 in addition to the constituents of the segment information generation device according to any one of the first exemplary embodiment to third exemplary embodiment. FIG. 5 illustrates only the segment information storage unit 10 among the constituents of the segment information generation device, and other constituents of the segment information generation device are omitted in their illustration.

In the following description, the segment information stored in the segment information storage unit 10 may be simply denoted as segment.

The linguistic processing unit 1 analyzes a character string of an input text. Specifically, the linguistic processing unit 1 makes morpheme analysis, syntax analysis, given-kana analysis, and the like. Kana-giving is a processing of giving kana to Chinese characters for pronunciation. Then, the linguistic processing unit 1 outputs, to the prosody generation unit 2 and the segment selection unit 3, information on symbol strings indicating "pronunciation" of phoneme symbols and the like, and information on word classes, inflected forms and accents of morphemes as linguistic analysis processing results on the basis of the analysis result.

The prosody generation unit 2 generates prosody of synthesis speech based on the linguistic analysis processing results output by the linguistic processing unit 1, and outputs prosody information on the generated prosody as target prosody information to the segment selection unit 3 and the waveform generation unit 4. The prosody generation unit 2 may generate prosody in the method described in Reference 5 cited later, for example.

[Reference 5]

Yasushi Ishikawa, "Prosodic Control for Japanese Text-to-Speech Synthesis", IEICE, IEICE research paper, Vol. 100, No. 392, pp. 27-34, 2000

The segment selection unit 3 selects segments meeting predetermined conditions from among the segments stored in the segment information storage unit 10 on the basis of the linguistic analysis processing results and the target prosody information, and outputs the selected segments and attribute information of the segments to the waveform generation unit 4. The operations by the segment selection unit 3 for selecting segments meeting predetermined conditions from among the segments stored in the segment information storage unit 10 will be described.

The segment selection unit 3 generates information on features of synthesis speech (which will be called "target segment environment" below) in units of speech synthesis on the basis of the input linguistic analysis processing results and target prosody information.

The target segment environment is information containing phonemes configuring synthesis speech to be generated based on the target segment environment (which will be denoted as relevant phoneme below), preceding phoneme before the relevant phoneme, subsequent phoneme after the relevant phoneme, presence of stress, distance from accent nucleus, pitch frequency in units of speech synthesis, power, duration in units of speech synthesis, cepstrum, Mel Frequency Cepstral Coefficients (MFCC), their Δ quantities, and the like. The Δ quantity indicates a degree of change per unit time.

Then, the segment selection unit 3 acquires a plurality of segments corresponding to consecutive phonemes from the segment information storage unit 10 in units of synthesis speech on the basis of the information contained in the generated target segment environment. That is, the segment selection unit 3 acquires a plurality of respective segments corresponding to the relevant phoneme, its preceding phoneme and its subsequent phoneme on the basis of the information contained in the target segment environment. The acquired segments are candidates of the segments to be used for generating synthesis speech, and will be denoted as candidate segments below.

The segment selection unit 3 calculates cost as an index indicating a degree of suitability of a segment used for synthesizing speech per combination of acquired adjacent candidate segments (such as combination of candidate segment corresponding to relevant phoneme and candidate segment corresponding to its preceding phoneme). The cost is a calculation result by a difference between the target segment environment and attribute information of a candidate segment, and a difference between attribute information of adjacent candidate segments.

The cost is low as a similarity between the features of synthesis speech indicated by the target segment environment and a candidate segment is higher or a degree of suitability for synthesizing speech is higher. Then, as segments with lower cost are used, synthesized speech has a higher degree of natural property indicating a similarity with human voice. Therefore, the segment selection unit 3 selects segments having the lowest cost calculated.

The cost calculated by the segment selection unit 3 specifically includes unit cost and connection cost. The unit cost indicates a degree of deterioration in sound quality which is estimated to occur when a candidate segment is used in an environment indicated by the target segment environment. The unit cost is calculated based on a similarity between attribute information of a candidate segment and the target segment environment. The connection cost indicates a degree of deterioration in sound quality which is estimated to occur when the segment environments between speech segments to be connected are discontinuous. The connection cost is calculated based on an affinity between the segment environments of adjacent candidate segments. Various methods for calculating unit cost and connection cost are proposed.

Generally, the unit cost is calculated by use of information contained in the target segment environment. The connection cost is calculated by use of pitch frequency, cepstrum, MFCC, short-time self-correlation, power, their Δ quantities and the like on the connection boundary between adjacent segments. Specifically, the unit cost and the connection cost are calculated by use of various items of information (such as pitch frequency, cepstrum and power) of the segments.

An example of unit cost calculation will be described. FIG. 6 illustrates respective information indicated by a target segment environment, and respective information indicated by attribute information of a candidate segment A1 and a candidate segment A2 by way of example.

In the present example, it is assumed that the pitch frequency indicated by the target segment environment is pitch0 [Hz], the duration is dur0 [sec], the power is pow0 [dB] and the distance from accent nucleus is pos0. It is assumed that the pitch frequency indicated by the attribute information of the candidate segment A1 is pitch1 [Hz], the duration is dur1 [sec], the power is pow1 [dB], and the distance from accent nucleus is pos1. It is assumed that the pitch frequency indicated by the attribute information of the candidate segment A2 is pitch2 [Hz], the duration is dur2 [sec], the power is pow2 [dB], and the distance from accent nucleus is pos2.

The distance from accent nucleus is a distance from phoneme as an accent nucleus in a speech synthesis unit. For example, for a speech synthesis unit made of 5 phonemes, when the third phoneme is an accent nucleus, the distance from the accent nucleus to a segment corresponding to the first phoneme is "−2", the distance from the accent nucleus to a segment corresponding to the second phoneme is "−1", the distance from the accent nucleus to a segment corresponding to the third phoneme is "0", the distance from the accent nucleus to a segment corresponding to the fourth phoneme is "+1" and the distance from the accent nucleus to a segment corresponding to the fifth phoneme is "+2."

Assuming the unit cost of the candidate segment A1 as unit_score(A1), unit_score(A1) may be calculated by the following Equation (7).

[Math. 7]

$$\text{unit_score}(A1) = (w1 \times (pitch0 - pitch1)^2) + (w2 \times (dur0 - dur1)^2) + (w3 \times (pow0 - pow1)^2) + (w4 \times (pos0 - pos1)^2) \quad \text{Equation (7)}$$

Similarly, assuming the unit cost of the candidate segment A2 as unit_score (A2), unit_score (A2) may be calculated in the following Equation (8).

[Math. 8]

$$\text{unit_score}(A2) = (w1 \times (pitch0 - pitch2)^2) + (w2 \times (dur0 - dur2)^2) + (w3 \times (pow0 - pow2)^2) + (w4 \times (pos0 - pos2)^2) \quad \text{Equation (8)}$$

In Equation (7) and Equation (8), w1 to w4 are predetermined weight coefficients.

Figures 7, 8:
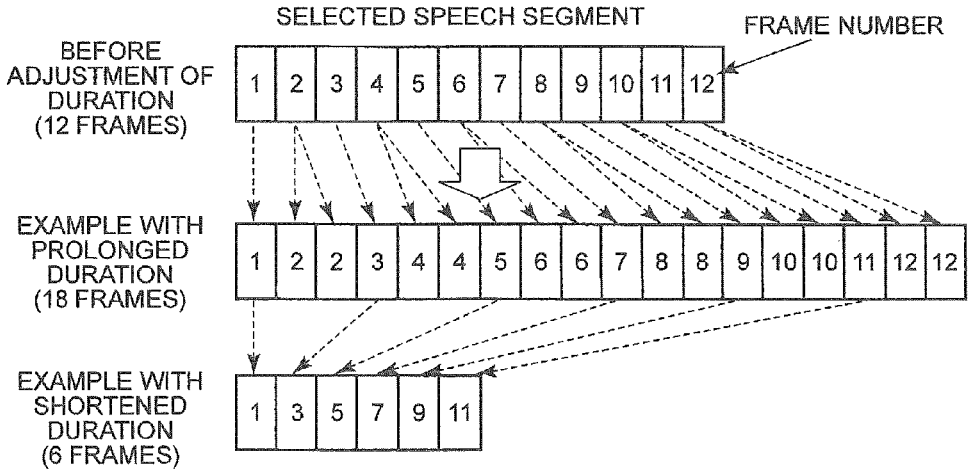
FIG. 7 It depicts an explanatory diagram illustrating respective information indicated by attribute information of candidate segments.
FIG. 8 It depicts a schematic diagram illustrating adjustment of a time length of a selected segment by way of example.

An example of connection cost calculation will be described below. FIG. 7 is an explanatory diagram illustrating respective information indicated by the attribute information of the candidate segment A1, the candidate segment A2, a candidate segment B1 and a candidate segment B2. The candidate segment B1 and the candidate segment B2 are candidate segments of subsequent segments of the candidate segment A1 and the candidate segment A2, respectively.

In the present example, it is assumed that the beginning pitch frequency of the candidate segment A1 is pitch_beg1 [Hz], the end pitch frequency is pitch_end1 [Hz], the beginning power is pow_beg1 [dB] and the end power is pow_end1 [dB]. It is assumed that the beginning pitch frequency of the candidate segment A2 is pitch_beg2 [Hz], the end pith frequency is pitch_end2 [Hz], the beginning power is pow_beg2 [dB] and the end power is pow_end2 [dB].

It is assumed that the beginning pitch frequency of the candidate segment B1 is pitch_beg3 [Hz], the end pitch frequency is pitch_end3 [Hz], the beginning power is pow_beg3 [dB], and the end power is pow_end3 [dB]. It is assumed that the beginning pitch frequency of the candidate segment B2 is pitch_beg4 [Hz], the end pitch frequency is pitch_end4 [Hz], the beginning power is pow_beg4 [dB] and the end power is pow_end4 [dB], Assuming the connection cost between the candidate segment A1 and the candidate segment B1 as concat_score (A1, B1), concat_score (A1, B1) may be calculated in the following Equation (9).

[Math. 9]

$$\text{concat_score}(A1, B1) = (c1 \times (\text{pitch_end1} - \text{pitch_beg3})^2) + (c2 \times (\text{pow_end1} - \text{pow_beg3})^2) \quad \text{Equation (9)}$$

Similarly, assuming the connection cost between the candidate segment A1 and the candidate segment B2 as concat_score(A1, B2), concat_score(A1, B2) may be calculated in the following Equation (10).

[Math. 10]

$$\text{concat_score}(A1, B2) = (c1 \times (\text{pitch_end1} - \text{pitch_beg4})^2) + (c2 \times (\text{pow_end1} - \text{pow_beg4})^2) \quad \text{Equation (10)}$$

Assuming the connection cost between the candidate segment A2 and the candidate segment E1 as concat_score (A2, B1), concat_score(A2, B1) may be calculated in the following Equation (11).

[Math. 11]

$$\text{concat_score}(A2, B1) = (c1 \times (\text{pitch_end2} - \text{pitch_beg3})^2) + (c2 \times (\text{pow_end2} - \text{pow_beg3})^2) \quad \text{Equation (11)}$$

Assuming the connection cost between the candidate segment A2 and the candidate segment B2 as concat_score (A2, B2), concat_score(A2, B2) may be calculated in the following Equation (12).

[Math. 12]

$$\text{concat_score}(A2, B2) = (c1 \times (\text{pitch_end2} - \text{pitch_beg4})^2) + (c2 \times (\text{pow_end2} - \text{pow_beg4})^2) \quad \text{Equation (12)}$$

In Equation (9) to Equation (12), c1 and c2 are predetermined weight coefficients.

The segment selection unit 3 calculates cost of the combination of the candidate segment A1 and the candidate segment B1 on the basis of the calculated unit cost and connection cost. Specifically, the segment selection unit 3 calculates the cost of the combination of the candidate segment A1 and the candidate segment B1 in a calculation formula of unit (A1)+unit(B1)+concat_score(A1, B1). Similarly, the segment selection unit 3 calculates the cost of the combination of the candidate segment A2 and the candidate segment B1 in a calculation formula of unit(A2)+unit (B1)+concat_score(A2, B1). Further, the segment selection unit 3 calculates the cost of the combination of the candidate segment A1 and the candidate segment B2 in a calculation formula of unit(A1)+unit(B2)+concat_score(A1, B2). The segment selection unit 3 calculates the cost of the combination of the candidate segment A2 and the candidate segment B2 in a calculation formula of unit(A2)+unit(B2)+concat_score(A2, B2).

The segment selection unit 3 selects a combination of segments with the minimum cost as the most suitable segments for speech synthesis from among the candidate segments. A segment selected by the segment selection unit 3 is called "selected segment."

The waveform generation unit 4 generates a speech waveform having prosody matched with or similar to the target prosody information on the basis of the target prosody information output by the prosody generation unit 2 as well as the segments output by the segment selection unit 3 and the attribute information of the segments. Then, the waveform generation unit 4 connects the generated speech waveforms to generate synthesis speech. A speech waveform generated in units of segment by the waveform generation unit 4 is denoted as segment waveform in order to discriminate from a normal speech waveform.

At first, the waveform generation unit 4 adjusts the number of frames such that the time length of a selected segment matches with or is similar to the duration generated in the prosody generation unit. FIG. 8 is a schematic diagram illustrating adjustment of the time length of a selected segment byway of example. In the present example, the number of frames of the selected segment is 12, and when the time length is prolonged (in other words, when the number of frames is increased), the number of frames thereof is 18. When the time length is shortened (in other words, when the number of frames is reduced), the number of frames is 6. The frame numbers illustrated in FIG. 8 indicate a correspondence relationship of the frames when the number of frames is increased or reduced. The waveform generation unit 4 inserts frames at a proper frequency when the number of frames is increased, and thins out frames when the number of frames is reduced. A frame to be inserted when the time length is increased employs its adjacent frame in many cases. FIG. 8 illustrates a case in which frames are inserted such that the frames with the even frame numbers are consecutive. An average frame among the neighboring frames may be used. In the example illustrated in FIG. 8, the frames with the even frame numbers are thinned out when the time length is shortened.

A frequency to insert or thin out frames is preferably equal in a segment as illustrated in FIG. 8. By doing so, sound quality of synthesis speech cannot be easily deteriorated.

Then, the waveform generation unit 4 selects a waveform to be used for generating a waveform in units of frame, thereby generating a segment waveform. A method for selecting frames is different between voiced sound and unvoiced sound.

Figure 9:
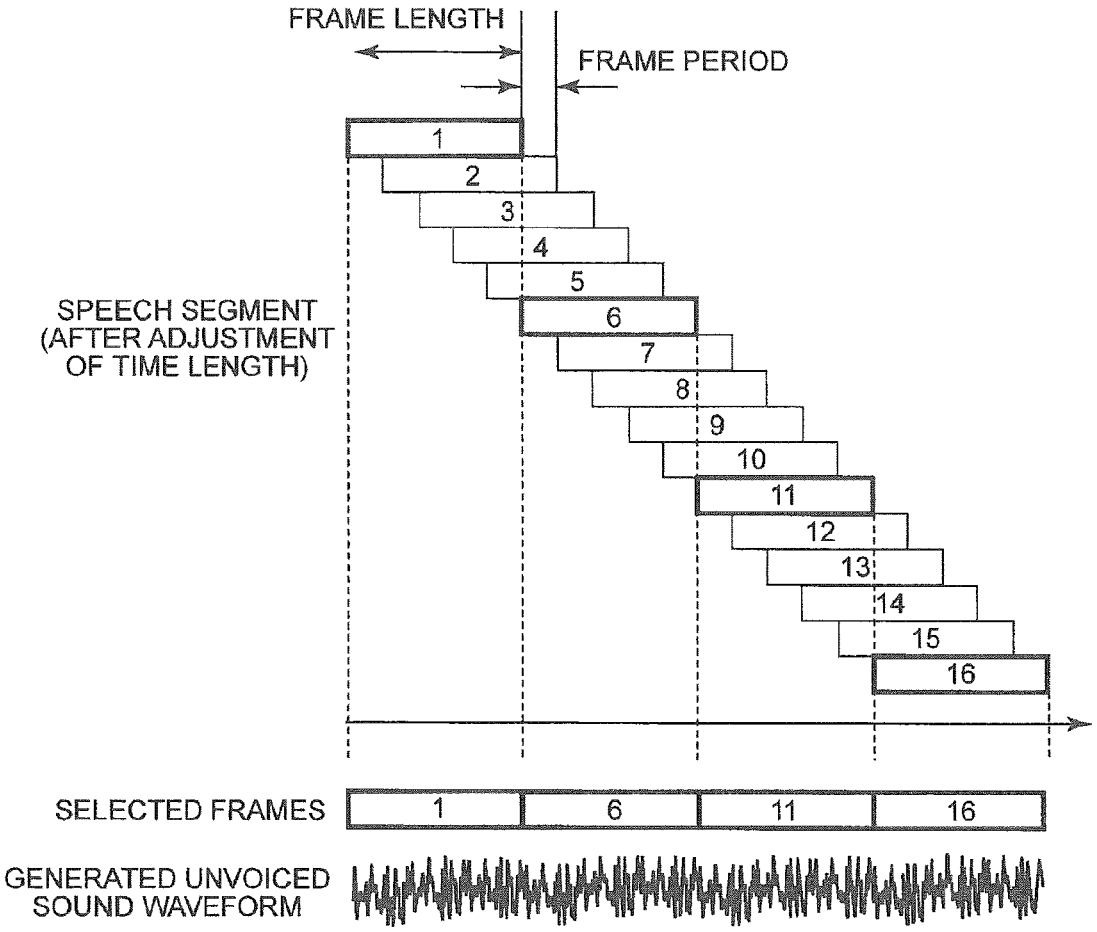
FIG. 9 It depicts an explanatory diagram illustrating how to generate an unvoiced sound waveform from a segment having 16 frames.

The waveform generation unit 4 calculates a frame selection period based on a frame length and a frame period so as to be the closest to the duration generated in the prosody generation unit 2 in the case of unvoiced sound. Then, it selects frames according to the frame selection period, and couples the waveforms of the selected frames thereby to generate an unvoiced sound waveform. FIG. 9 is an explanatory diagram illustrating how to generate an unvoiced sound waveform from a segment having 16 frames. In the example illustrated in FIG. 9, since the frame length is five times longer than the frame period, the waveform generation unit 4 selects frames to be used for generating an unvoiced sound waveform one time per five frames.

Figure 10:
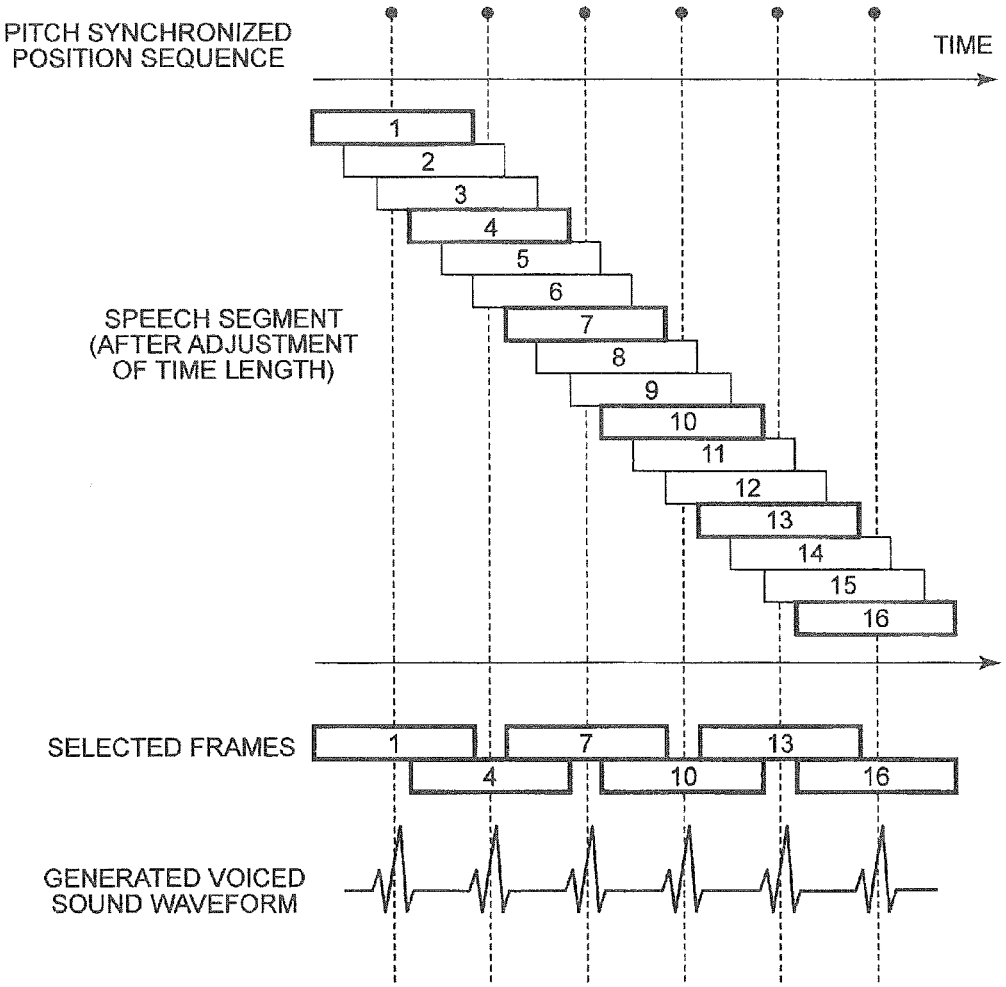
FIG. 10 It depicts an explanatory diagram illustrating how to generate a voiced sound waveform from a segment having 16 frames.

The waveform generation unit 4 calculates a pitch synchronized time (which may be called pitch mark) from the pitch frequency time series generated in the prosody generation unit 2 in the case of voiced sound. Then, the waveform generation unit 4 selects the closest frames to the pitch synchronized time, and arranges the centers of the selected respective frames at the pitch synchronized time thereby to generate a voiced sound waveform. FIG. 10 is an explanatory diagram illustrating how to generate a voiced sound waveform from a segment having 16 frames. In the example illustrated in FIG. 10, the frames corresponding to the pitch synchronized time are the first, 4th, 7th, 10th, 13th, and 16th frames, and thus the waveform generation unit 4 generates a waveform by use of the frames. A method for calculating a pitch synchronized position from a pitch frequency time series is described in Reference 6 cited later, for example. The waveform generation unit 4 may calculate a pitch synchronized position in the method described in Reference 6.

[Reference 6]

Huang, Acero, Hon, "Spoken Language Processing", Prentice Hall, pp. 689-836, 2001

At last, the waveform generation unit 4 sequentially couples the voiced sound waveform and the unvoiced sound waveform generated in units of segment from the heads thereby to generate a synthesis speech waveform.

In the present exemplary embodiment, the linguistic processing unit 1, the prosody generation unit 2, the segment selection unit 3, the waveform generation unit 4, and the parts corresponding to the constituents in the segment information generation device (such as the waveform cutout unit 14, the feature parameter 15, and the time domain waveform conversion unit 22) are accomplished by the CPU in a computer operating according to a speech synthesis program, for example. In this case, the CPU may read the program and operate as each constituent. The each constituent may be accomplished in individual hardware.

Figure 11:
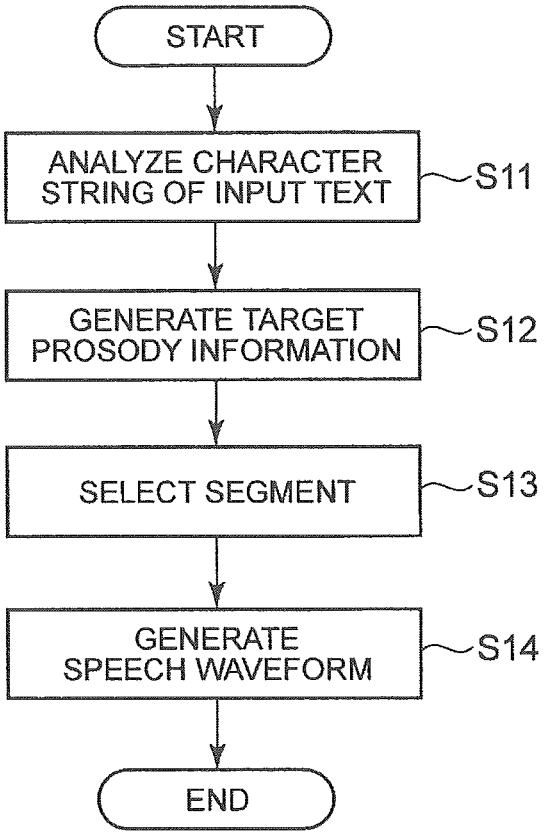
FIG. 11 It depicts a flowchart illustrating an exemplary processing progress according to the fourth exemplary embodiment of the present invention.

FIG. 11 is a flowchart illustrating an exemplary processing progress according to the present exemplary embodiment. It is assumed that the segment information storage unit 10 stores segment information by the operations indicated by any one of the first to third exemplary embodiments. The linguistic processing unit 1 analyzes a character string of an input text (step S11). Then, the prosody generation unit 2 generates target prosody information based on the result in step S1 (step S12). Subsequently, the segment selection unit 3 selects a segment (step S13). The waveform generation unit 4 generates a speech waveform having prosody matched with or similar to the target prosody information on the basis of the target prosody information generated in step S12 as well as the segments selected in step S13 and the attribute information of the segments (step S14).

Also in the present exemplary embodiment, the same effects as those in the first to third exemplary embodiments can be obtained.

Figure 12:
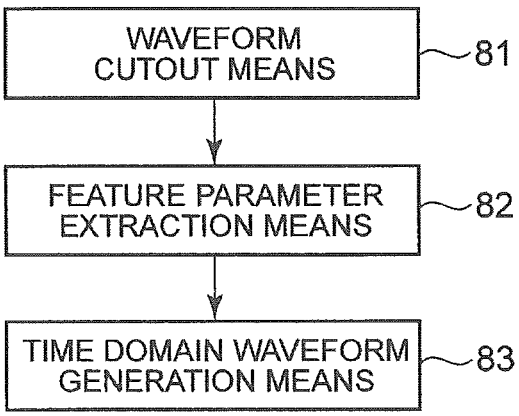
FIG. 12 It depicts a block diagram illustrating an exemplary minimum structure of a segment information generation device according to the present invention.

A minimum structure of the present invention will be described below. FIG. 12 is a block diagram illustrating an exemplary minimum structure of a segment information generation device according to the present invention. The segment information generation device according to the present invention includes a waveform cutout means 81, a feature parameter extraction means 82 and a time domain waveform generation means 83.

The waveform cutout means 81 (such as the waveform cutout unit 14) cuts out a speech waveform from natural speech at a time period not depending on a pitch frequency of the natural speech.

The feature parameter extraction means 82 (such as the feature parameter extraction unit 15) extracts a feature parameter of a speech waveform from the speech waveform cut out by the waveform cutout means 81.

The time domain waveform generation means 83 (such as the time domain waveform conversion unit 22) generates a time domain waveform based on the feature parameter.

With the structure, a waveform can be generated with fewer calculations. Further, when speech synthesis is made by use of a segment in an interval in which a pitch frequency of natural speech is low, a deterioration in sound quality of synthesis speech can be prevented, and the amount of segment information data can be reduced in an interval in which a pitch frequency is high without losing the sound quality of synthesis speech.

Figure 13:
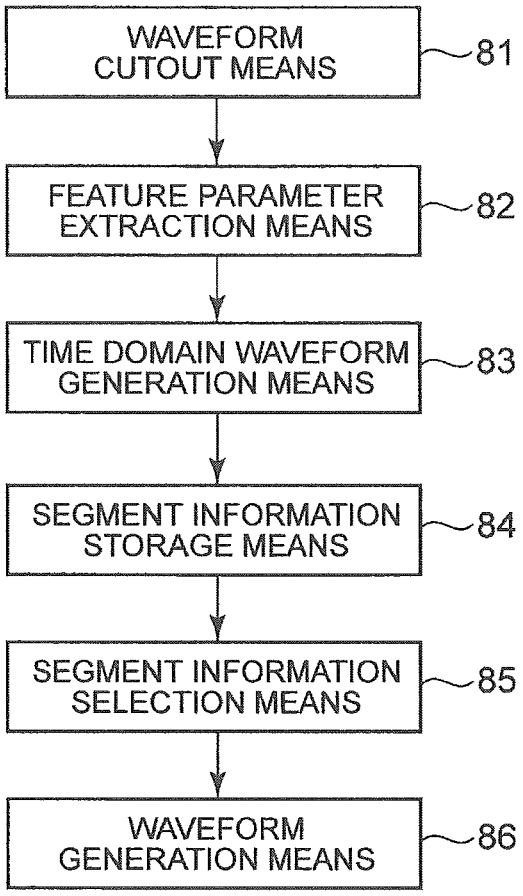
FIG. 13 It depicts a block diagram illustrating an exemplary minimum structure of a speech synthesis device according to the present invention.

FIG. 13 is a block diagram illustrating an exemplary minimum structure of a speech synthesis device according to the present invention. The speech synthesis device according to the present invention includes the waveform cutout means 81, the feature parameter extraction means 82, the time domain waveform generation means 83, a segment information storage means 84, a segment information selection means 85 and a waveform generation means 86. The waveform cutout means 81, the feature parameter extraction means 82 and the time domain waveform generation means 83 are the same as those illustrated in FIG. 12, and an explanation thereof will be omitted.

The segment information storage means 84 (such as the segment information storage unit 10) stores segment information indicating a segment and containing a time domain waveform generated by the time domain waveform generation means 83.

The segment information selection means 85 (such as the segment selection unit 3) selects segment information corresponding to an input character string.

The waveform generation means 86 (such as the waveform generation unit 4) generates a speech synthesis waveform by use of the segment information selected by the segment information selection means 85.

With the above structure, the same effects as those in the segment information generation device illustrated in FIG. 12 can be obtained.

Part of or all the above exemplary embodiments may be described in the following Supplementary notes, but are not limited thereto.

(Supplementary note 1) A segment information generation device including a waveform cutout unit that cuts out a speech waveform from natural speech at a time period not depending on a pitch frequency of the natural speech, a feature parameter extraction unit that extracts a feature parameter of a speech waveform from the speech waveform cut out by the waveform cutout unit, and a time domain waveform generation unit that generates a time domain waveform based on the feature parameter.

(Supplementary note 2) The segment information generation device according to Supplementary note 1, including a period control unit that determines a time period to cut out a speech waveform from natural speech based on attribute information of the natural speech.

(Supplementary note 3) The segment information generation device according to Supplementary note 1 or Supplementary note 2, including a spectrum shape change degree estimation unit that estimates a degree of change in spectrum shape indicating a degree of change in spectrum shape of natural speech, and a period control unit that determines a time period to cut out a speech waveform from the natural speech based on the degree of change in spectrum shape.

(Supplementary note 4) The segment information generation device according to Supplementary note 3, wherein when a degree of change in spectrum shape is determined to be small, the period control unit sets a time period to cut out a speech waveform from natural speech to be longer than a time period during normal time.

(Supplementary note 5) The segment information generation device according to Supplementary note 3 or Supplementary note 4, wherein when a degree of change in spectrum shape is determined to be large, the period control unit sets a time period to cut out a speech waveform from natural speech to be shorter than a time period during normal time.

(Supplementary note 6) a speech synthesis device including a waveform cutout unit that cuts out a speech waveform from natural speech at a time period not depending on a pitch frequency of the natural speech, a feature parameter extraction unit that extracts a feature parameter of a speech waveform from the speech waveform cut out by the waveform cutout unit, a time domain waveform generation unit that generates a time domain waveform based on the feature parameter, a segment information storage unit that stores segment information indicating a segment and containing the time domain waveform, a segment information selection unit that selects segment information corresponding to an input character string, and a waveform generation unit that generates a speech synthesis waveform by use of the segment information selected by the segment information selection unit.

The present application claims the priority based on Japanese Patent Application No. 2011-117155 filed on May 25, 2011, and the disclosure of which is all incorporated herein.

The present invention has been described above with reference to the exemplary embodiments, but the present invention is not limited to the exemplary embodiments. The structure and details of the present invention may be variously modified within the scope of the present invention understood by those skilled in the art.

INDUSTRIAL APPLICABILITY

The present invention is suitably applied to a segment information generation device for generating segment information to be used for synthesizing speech, and a speech synthesis device for synthesizing speech by use of segment information.

REFERENCE SIGNS LIST

1: Linguistic processing unit
2: Prosody generation unit
3: Segment selection unit
4: Waveform generation unit
10: Segment information storage unit
11: Attribute information storage unit
12: Natural speech storage unit
14: Waveform cutout unit
15: Feature parameter extraction unit
20: Analysis frame period storage unit
22: Time domain waveform conversion unit
30, 40: Analysis frame period control unit
41: Spectrum shape change degree estimation unit

The invention claimed is:

1. A segment information generation device comprising:

a waveform cutout unit implemented at least by hardware including a processor that cuts out a speech waveform from natural speech at a time period not depending on a pitch frequency of the natural speech, continuously;

a feature parameter extraction unit implemented at least by hardware including a processor that extracts a feature parameter of a speech waveform from the speech waveform cut out by the waveform cutout unit;

a time domain waveform generation unit implemented at least by hardware including a processor that generates a time domain waveform based on the feature parameter;

a spectrum shape change degree estimation unit implemented at least by hardware including a processor that estimates a degree of change in spectrum shape indicating a degree of change in spectrum shape of natural speech; and a period control unit implemented at least by hardware including a processor that determines a time period to cut out a speech waveform from the natural speech based on the degree of change in spectrum shape.

2. The segment information generation device according to claim 1, wherein the period control unit determines the time period to cut out a speech waveform from natural speech based on attribute information of the natural speech.

3. The segment information generation device according to claim 1, wherein when a degree of change in spectrum shape is determined to be small, the period control unit sets a time period to cut out a speech waveform from natural speech to be longer than a time period during normal time.

4. The segment information generation device according to claim 1, wherein when a degree of change in spectrum shape is determined to be large, the period control unit sets a time period to cut out a speech waveform from natural speech to be shorter than a time period during normal time.

5. A speech synthesis device comprising:

a waveform cutout unit implemented at least by hardware including a processor that cuts out a speech waveform from natural speech at a time period not depending on a pitch frequency of the natural speech, continuously;

a feature parameter extraction unit implemented at least by hardware including a processor that extracts a feature parameter of a speech waveform from the speech waveform cut out by the waveform cutout unit;

a time domain waveform generation unit implemented at least by hardware including a processor that generates a time domain waveform based on the feature parameter;

a segment information storage unit implemented by a storage device that stores segment information indicating a segment and containing the time domain waveform;

a segment information selection unit implemented at least by hardware including a processor that selects segment information corresponding to an input character string;

a waveform generation unit implemented at least by hardware including a processor and that generates a speech synthesis waveform by use of the segment information selected by the segment information selection unit;

a spectrum shape change degree estimation unit implemented at least by hardware including a processor that estimates a degree of change in spectrum shape indicating a degree of change in spectrum shape of natural speech; and a period control unit implemented at least by hardware including a processor that determines a time period to cut out a speech waveform from the natural speech based on the degree of change in spectrum shape.

6. A segment information generating method, implemented by a processor, comprising:

cutting out a speech waveform from natural speech at a time period not depending on a pitch frequency of the natural speech, continuously;

extracting a feature parameter of the speech waveform from the speech waveform;

generating a time domain waveform based on the feature parameter;

estimating a degree of change in spectrum shape indicating a degree of change in spectrum shape of natural speech; and determining a time period to cut out a speech waveform from the natural speech based on the degree of change in spectrum shape.

7. The segment information generation device according to claim 1, further comprising:

a spectrum shape change degree estimation unit comprising a processor that estimates a degree of change in spectrum shape indicating a degree of change in spectrum shape of natural speech.

8. The segment information generation device according to claim 1, further comprising:

a natural speech storage unit comprising a storage device that stores information indicating a natural speech waveform of the natural speech.

9. The segment information generation device according to claim 8, further comprising:

an attribute information storage unit comprising a storage device that stores, as attribute information, linguistic information indicating character strings corresponding to the natural speech, and prosody information of the natural speech.

10. The segment information generation device according to claim 9, wherein the linguistic information comprises information on at least one of pronunciation, syllable string, phoneme string, accent position, accent phrase separation and morphemic word class.

11. The segment information generation device according to claim 9, wherein the prosody information comprises at least one of pitch frequency, amplitude, short-time power time series, and duration of respective syllables, phonemes and pauses contained in the natural speech.

12. The segment information generation device according to claim 1, further comprising:

a segment information storage unit comprising a storage device that stores segment information indicating a segment and comprising the time domain waveform.

* * * * *